US005522189A

United States Patent [19]

Mortensen et al.

[11] Patent Number: 5,522,189

[45] Date of Patent: Jun. 4, 1996

[54] FLASHING FOR ROOF ELEMENTS

[75] Inventors: Bent R. Mortensen, Odense; Ole M. Vedel, Frederiksborg; Peter Alkjær, Brøndby, all of Denmark

[73] Assignee: V. Kann Rasmussen Industri A/S, Søborg, Denmark

[21] Appl. No.: 319,529

[22] Filed: Oct. 7, 1994

[30] Foreign Application Priority Data

Apr. 18, 1994 [DK] Denmark ..... 0444/94

[51] Int. Cl.[6] ..... E04B 7/18

[52] U.S. Cl. ..... 52/200; 52/58; 52/537

[58] Field of Search ..... 52/58, 200, 537

[56] References Cited

U.S. PATENT DOCUMENTS

| | | | |
|---|---|---|---|
| 1,105,422 | 7/1914 | Griffiths | 52/58 |
| 1,329,794 | 2/1920 | Moomaw | 52/537 X |
| 4,781,008 | 11/1988 | Lyons, Jr. | 52/58 X |
| 4,864,781 | 9/1989 | Emblin | 52/58 |
| 4,972,638 | 11/1990 | Minter | 52/58 X |
| 5,046,292 | 9/1991 | Sampson et al. | 52/200 |
| 5,077,943 | 1/1992 | McGady | 52/58 |
| 5,299,396 | 4/1994 | Raap et al. | 52/58 X |

*Primary Examiner*—Wynn E. Wood
*Assistant Examiner*—W. Glenn Edwards
*Attorney, Agent, or Firm*—Lane, Aitken & McCann

[57] ABSTRACT

A flashing arrangement for mounting of a roof element in a roof having a thin sheet-formed roofing comprises flashing elements for connection with the main frame members and is made from a sheet material. The flashing elements intended for connection with the side members of the main frame are of a substantially L-shaped cross-section with an upright flange portion for bearing against the side member of the main frame and a flange portion protruding substantially parallel to the roof surface. The protruding flange portion is folded to form at least one slot in its longitudinal direction, said slot having an opening facing away from the main frame side member for receiving an edge portion of the thin sheet-formed roofing.

11 Claims, 4 Drawing Sheets

FLASHING FOR ROOF ELEMENTS

Figure 1:
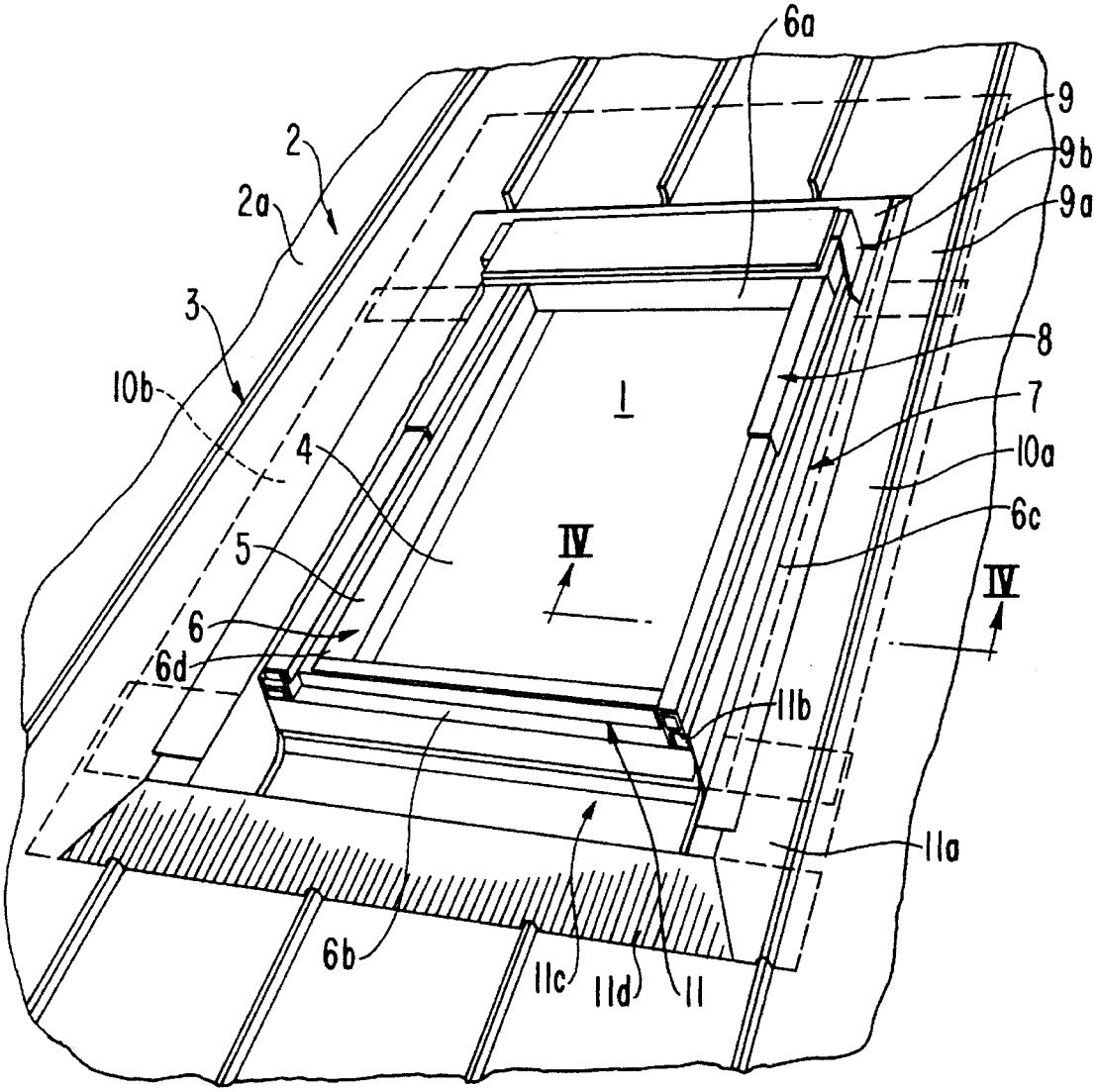

The invention relates to a flashing arrangement for mounting of a roof element in a roof having a thin sheet-formed roofing, in particular a roof window having a mainly rectangular main frame composed of a top member, two side members and a bottom member, said flashing arrangement comprising flashing elements for connection with the main frame members and made from a sheet material, flashing elements intended for connection with the side members of the main frame being of a substantially L-shaped cross-section with an upright flange portion for bearing against the side member of the main frame and a flange portion protruding substantially parallel to the roof surface.

When mounting windows in inclined roofs it is important that a water-and weathertight connection between the main frame structure of the window and the surrounding roofing be provided. This connection is, dependent on the nature of the roofing, in different ways inserted under the roofing and may comprise sealing means for bearing against the underside thereof. It is further necessary that the roofing may be securely connected to the roof element or the window construction so that there will be no risk that the roofing around the built-in roof element will lift from the supporting construction of the roof influenced by e.g. a strong wind.

Thus it is known to provide windows, which are built-in in a roof having a corrugated roofing, e.g. from tiles, with a connection in the form of a flashing comprising a weather strip. Due to the rather high dead load of the tiles the roofing bears against the weather strip and thereby against the roof construction thus securing a water- and weathertight connection as well as a safe fastening between the roofing and the roof construction. With substantially plane roofings, such as slates and the like, where it is a question of small elements of great rigidity the possibility exists to fasten them near the flashing.

Using light roofings in long lengths it is rather more difficult to secure a tight connection and a safe fastening. This is the case e.g. in roofings made from a thin metal sheet which in various ways may be profiled in the direction of inclination of the roof. Here the roofing has formerly been secured by means of methods such as glueing or puttying which enhances a difficult mounting of the flashing as well as a far more insecure fastening and sealing.

On the background hereof it is the object of the invention to provide a flashing which remedies the above mentioned drawbacks and which further is easily mountable in connection with roofings made from thin metal sheets, independent of the profile thereof.

According to the invention a flashing arrangement is provided for mounting of a roof element in a roof having a thin sheet-formed roofing, in particular a roof window having a mainly rectangular main frame composed of a top member, two side members and a bottom member, said flashing arrangement comprising flashing elements for connection with the main frame members and made from a sheet material, flashing elements intended for connection with the side members of the main frame being of a substantially L-shaped cross-section with an upright flange portion for bearing against the side member of the main frame and a flange portion protruding substantially parallel to the roof surface, said protruding flange portion being folded to form at least one slot in its longitudinal direction, said slot having an opening facing away from the main frame side member for receiving an edge portion of the thin sheet-formed roofing.

By means of this flashing arrangement a good tightness between the main frame and the surrounding roofing as well as a secure fastening to the underlying roof construction are attained. Further the flashing arrangement is easily connected with the main frame structure and the roofing.

As the opening of the slot, or the slots, faces away from the window an especially easy mounting of the flashing arrangement in the surrounding roofing is obtained as the cut-off edge portion of the metal sheet adjacent the protruding flange portion of the flashing may easily be inserted in the slot.

The forming of the slot or the slots by folding the protruding flange portion of the side members of the flashing arrangement causes that they may be made in one piece which makes the production cheaper and easier.

As a special advantage in connection with roofings having a trapezoidal or rib-like profile shape the invention offers the possibility of a suitable overlap between the flashing elements and the edge portion of the roofing, independent of the shape of the roofing. In an embodiment especially suited for this purpose the protruding flange portion is provided with at least two mutually separated and mainly parallel slots which offers the possibility of mounting the edge portion of the roofing in several different distances from the side member of the main frame.

Further details and advantages in the flashing arrangement according to the invention will appear from the subclaims.

Figure 3:
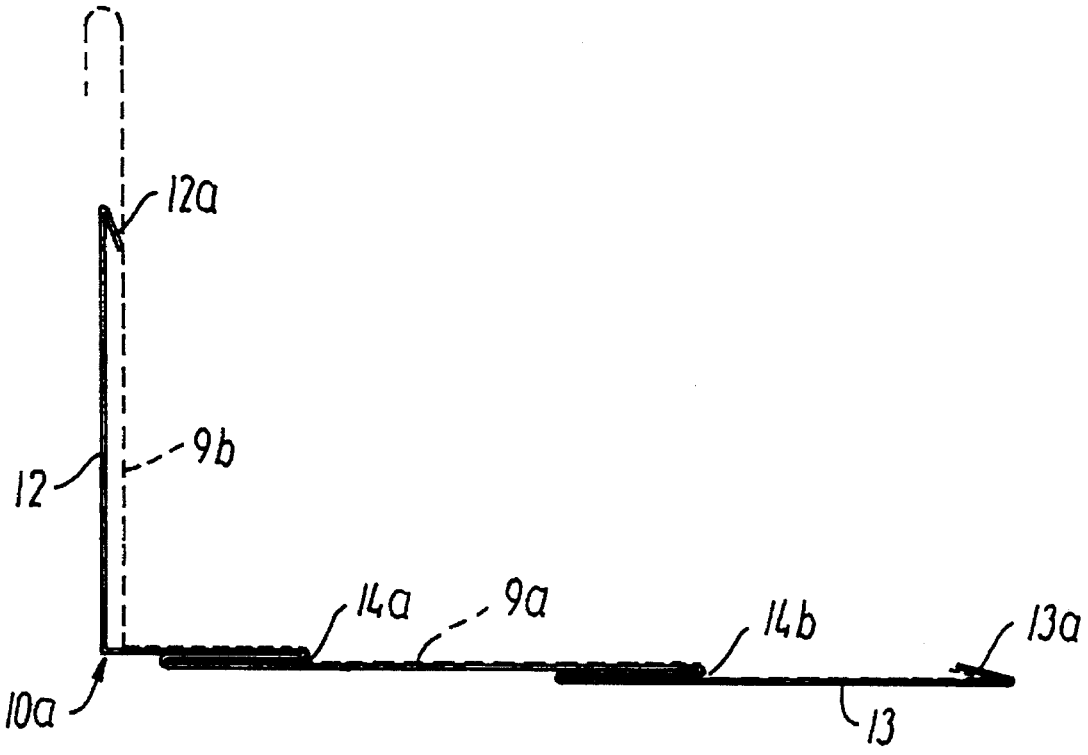
Figure 4:
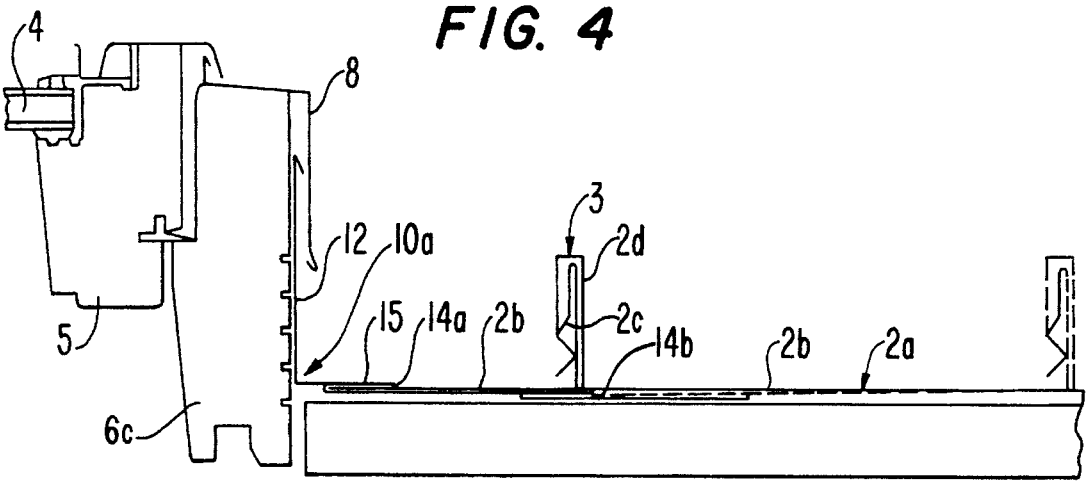
Figure 5:
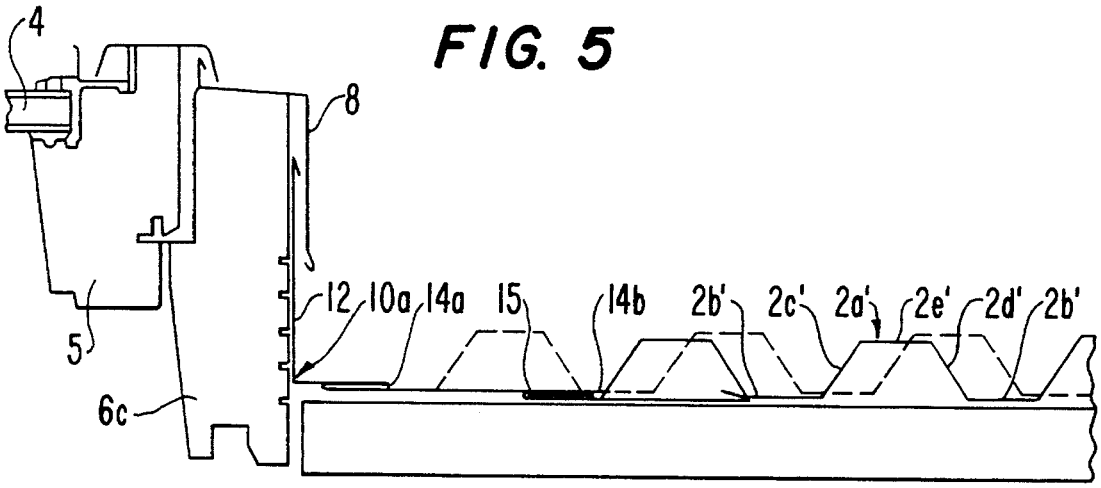

In the following the invention will be further explained with reference to the schematical drawing, in which FIG. 1 is a perspective view of a window which is built-in in a profiled metal roof, and which is surrounded by a flashing arrangement according to the invention, FIG. 2 in a larger scale is a view of a detail of the flashing arrangement according to the invention, FIG. 3 in a larger scale is a view of another detail of the flashing arrangement according to the invention, FIG. 4 is a cross-sectional view along the line IV—IV of FIG. 1, FIG. 5 is a view as in FIG. 4, but the profile of the metal roofing being different, and FIG. 6 in a larger scale is a view of a detail of the flashing arrangement according to another embodiment of the invention.

The window 1 shown in FIG. 1 is in the form of a skylight and is built-in in an inclined roof having a roofing 2 made from thin metal sheets 2*a* with a profile 3 extending in the direction of inclination of the roof, said profile comprising flat bottom portions 2*b* and upright ribs 2*c*, 2*d* (cf. FIG. 4). The window comprises a pane 4, a glass-carrying window frame 5 and a main frame 6 composed of a top member 6*a*, a bottom member 6*b* and two side members 6*c*, 6*d*. The main frame 6 is connected to the roofing 2 by means of a flashing arrangement 7 which on one side is inserted under the cladding 8 of the main frame and on the other side is connected to the roofing 2 so that water and other downpour cannot penetrate under it.

The flashing arrangement 7 comprises an upper element 9 for connection with the top member 6*a* of the main frame which constitutes a gutter at the top of the window, two side elements 10*a*, 10*b* for connection with the side members 6*c*, 6*d* of the main frame and a bottom element 11 for connection with the bottom member 6*b* of the main frame. The bottom element 11 is at the sides provided with an upright flange 11*b* and with a flange portion 11*a* protruding in the plane of the roofing which when mounted is adapted to be overlapped by corresponding flange portions on the side elements 10*a*, 10*b* of the flashing arrangement. The element 11 further comprises a front edge 11*c* and a plastically deformable skirt 11*d* which may be made from lead or other deformable material. The skirt 11*d* is placed on top of the underlying roofing 2 and is sealingly formed against same. The element 9 is provided with side sections extending outwards in the extension of the gutter and comprising in the mounted position of the gutter an upright flange portion 9*b* and a flange portion 9*a* protruding in the plane of the roofing and on each side of the top member 6*a* of the main frame overlapping the side portions 10*a*, 10*b* of the flashing arrangement 7. Water collected in the gutter of the upper element 9 is conducted round the upper corners of the main frame, down along the side members 6*c*, 6*d* of the main frame, over the front edge 11*c* and the skirt 11*d* and out on the roofing 2.

Figure 2:
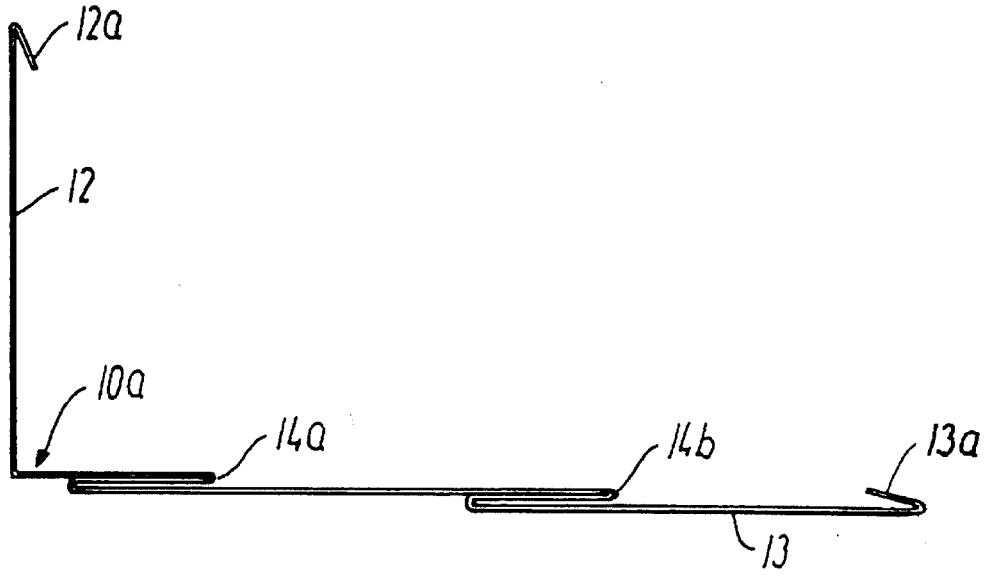

In FIG. 2 one of the side elements 10*a* of the flashing arrangement is shown having a substantially L-shaped cross-section where an upright flange portion 12 having a turned-in flap 12*a* is adapted to be inserted under the cladding 8 of the main frame and to be fastened to the side member 6*c* of the main frame (cf. FIG. 4). A protruding flange portion 13, which when mounted is parallel to the roof surface, is in the shown embodiment provided with a first 14*a* and a second 14*b* longitudinally extending slot by means of two subsequent foldings. The slots 14*a*, 14*b* have openings facing away from the window 1 and are adapted to receive and fasten an edge portion 15 shown in FIG. 4 of the metal sheet of the roofing 2 closest to the window. Dependent on the positioning of the ribs of the profile 3 of the roofing in relation to the window, the metal sheet may be engaged in either one or the other of these slots. At its end the protruding flange portion 13 is adapted to fasten the side member 10*a* to the underlying roof construction by means of fastening cleats or clips, not shown, and is further provided with a turned-in flap 13*a* forming a stop for water penetration under the roofing when mounting the flashing.

In FIG. 3 it is shown how the flashing element 9 for connection with the top member of the main frame and to form a gutter is connected to the flashing element 10*a* at the side member of the main frame. At the ends the element 9 is provided with an upright 9*b* and a protruding 9*a* flange portion which overlap the corresponding flange portions 12, 13 of the flashing element 10*a*. For this purpose the protruding flange portion 9*a* is provided with two slots corresponding to the slots 14*a*, 14*b*. The connection, not shown, between the side elements 10*a*, 10*b* and the bottom flashing element 11 is brought about in a similar manner by providing the protruding flange portion 11*a* of this element 11 with two slots.

In FIG. 4 a section through the window 1 with the flashing arrangement 7 and a rib-profiled roofing 2 is shown, in which it with full-drawn line is shown how the edge portion 15 of the flat bottom portion 2*b* of the roofing 2 has been inserted into the first slot 14*a* of the side element of the flashing arrangement. In dotted line it is shown how the edge portion of the metal sheet can be inserted into the other slot 14*b* in another positioning of the ribs of the profile 3. The metal sheets constituting the roofing are here composed of sheets 2*a* extending in the direction of inclination of the roof and having a U-shaped cross-section comprising a flat bottom portion 2*b* and upright rib flanges 2*c*, 2*d* at the opposite lateral edges, of which the one 2*d* is provided with a folding for engaging the other upright flange 2*c* of the neighbouring plate, whereby two adjacent plates are locked together by snap engagement.

FIG. 5 shows a roofing where the profile is in the form of a trapezoidal plate 2*a*′ having flat, longitudinal bottom portions 2*b*′ and upright flanges 2*c*′, 2*d*′being upwards diverging and at the top being connected to the flange of the adjacent portion by means of a top portion 2*e*′. As shown, the top and bottom portions may be of equal width, but it is, of course, also possible that one of the portions is smaller than the other. In full-drawn line it is shown how a section of a bottom portion of the trapezoidal form is inserted into the other slot 14*b* of the side element 10*a* of the flashing, while in dotted line another bottom portion inserted into the first slot 14*a* is shown. The distance between the openings of the slots 14*a* and 14*b* is 10–15 mm greater than the distance between two adjacent bottom portions of the profile 3 of the roofing in order to secure a suitable overlap between the roofing and the flashing, it being possible during mounting to cut one of the flat bottom portions in such a way that a border portion thereof may always be inserted into the first or the second slot.

Figure 6:
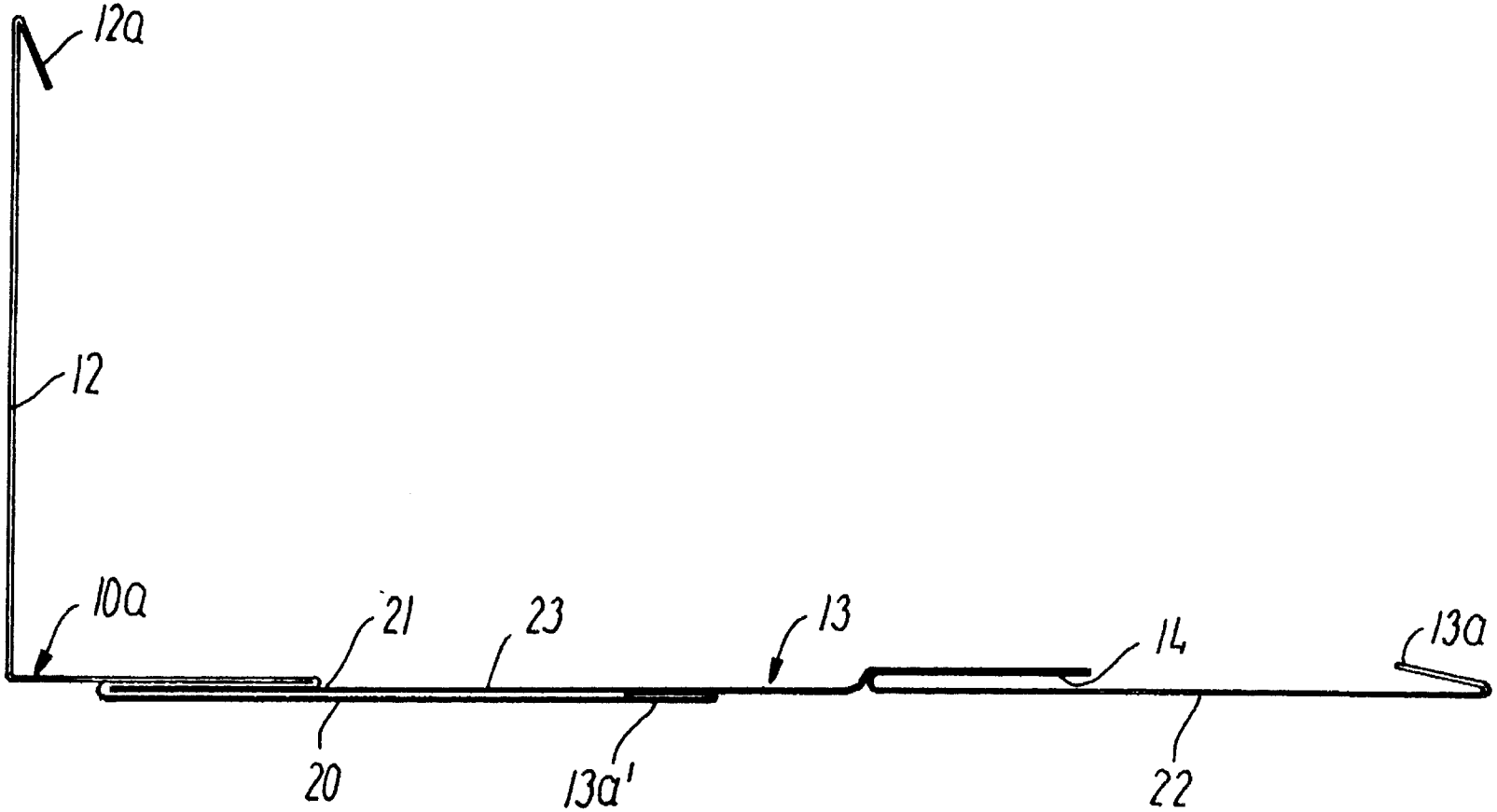

FIG. 6 shows another embodiment of the side element 10a of the flashing, in which the upright flange portion 12 including the turned-in flap 12*a* is designed as in the embodiment shown in FIG. 2. The protruding flange portion 13, on the other hand, is divided into two and comprises a first part 20 forming an integrated part of the upright flange portion 12 and a second part 22 in the shape of an adapter piece 22 including the slot 14 intended for connection of the edge portion of the sheet-like roofing with said first part 20. The adapter piece 22 is connected to the first part 20 in that a flat edge portion 23 thereof is inserted into a slot 21 in the first part 20 having the same shape and being formed in the same way as the slot 14. Further, as in the embodiment illustrated in FIG. 2, the adapter piece 22 comprises a turned-in flap 13*a* forming a stop for penetration of water under the roofing.

The adaption to various shapes of the roofing is carried out in that the flat edge portion 23 of the adapter piece 22 is cut off at a suitable distance from the slot 14. It is further possible that the slot 21 of the first part 20 may constitute the receiving slot for the edge portion of the roofing. To this purpose the first part 20 is at its outer edge provided with a turned-in flap 13*a*′ which when using the adapter piece 22 is bent completely down onto the upper side of the outer edge of said first part, the outer edge hereinafter being secured to the underlying roof structure prior to the adapter piece 22 being inserted into the slot 21 and the edge portion of the roofing finally being inserted into the slot 14. This increases the strength of the securing of the roofing to the underlying roof structure.

Moreover, this embodiment of the flashing side element 10*a* can be used as a flashing element at the main frame bottom member 6*b*. In this case the side element 10*a* with its upright flange portion 12 is inserted under the cladding of the main frame and fastened to the main frame. A flat connecting piece having a length corresponding to the width of the window is placed below the main frame bottom member and an upper longitudinal portion of the connecting piece is inserted into the slot 14 of the first part 20 and the opposite longitudinal portion is placed over the roofing. It is, of course, possible to make use of the adapter piece 22 for adapting the flashing to different distances between the bottom member of the main frame and the roofing below the window. The side element 10*a* being used as a flashing element at the bottom member of the main frame together with the flat connecting piece and possibly in connection with the adapter piece entails the advantage that the skirt 11*d* can be totally disposed of.

The flashing may also be made from synthetic material, such as plastic or rubber, where the individual parts may be glued in the overlaps or they may be welded together.

The flashing arrangement according to the invention is useable in connection with roof elements which are to pass through the sheet-formed roofing. Examples of such roof elements are skylights, roof windows being fixed or openable, solar collectors, chimneys, ventilating pipes or erections.

We claim:

1. A flashing arrangement for mounting in a roof having a thin sheet-formed roofing (2), said flashing arrangement comprising in particular a roof element having a mainly rectangular main frame (6) composed of a top member, two side members and a bottom member, said flashing arrangement further comprising flashing elements (9,10*a*,10*b*,11) for connection with the main frame members and made from a sheet material, said flashing elements, intended for connection with the side members of the main frame, being of a substantially L-shaped cross-section with an upright flange portion (12) for bearing against the side member of the main frame and a flange portion (13) protruding substantially parallel to the roof surface, said protruding flange portion (13) being folded in its longitudinal direction to form at least two mutually separated and mainly parallel slots, said slots having openings facing away from the main frame side member for receiving an edge portion (15) of the thin sheet-formed roofing.

2. A flashing arrangement according to claim 1, in particular for use in connection with roofings having a trapezoidal or rib-like profile shape, wherein the mutual separated openings of said slots (14*a*, 14*b*) is adapted to the profile shape (3) of the roofing in such a way as to permit said edge portion (15) of the roofing to be received in one of the slots independent of the shape of the roofing.

3. A flashing arrangement according to claim 2, wherein said separation is approximately 10–15 mm greater than the distance between two adjacent flat bottom portions (2*b*, 2*b*') of the profile shape of the roofing.

4. A flashing arrangement for mounting element in a roof having a thin sheet-formed roofing (2), said flashing arrangement in comprising a roof element having a mainly rectangular main frame (6) composed of a top member, two side members and a bottom member, said flashing arrangement further flashing elements (9,10*a*,10*b*,11) for connection with the main frame members and made from a sheet material, said flashing elements, intended for connection with the side members of the main frame, being of a substantially L-shaped cross-section with an upright flange portion (12) for bearing against the side member of the main frame and a flange portion (13) protruding substantially parallel to the roof surface, wherein the protruding flange portion (13) comprises a first part forming an integral part of the upright flange portion (12) and a second part for connection with said first part, said second part being provided with a slot for receiving the edge portion (15) of the roofing.

5. A flashing arrangement according to claim 4, wherein said second part comprises a flat portion intended to be received in a slot in said first part, said slot having an opening facing away from the main frame side member, and wherein the width of said flat portion is intended to be adapted in such a way that the edge portion of the roofing may be received in the slot of said first part independent of the shape of the roofing.

6. A flashing arrangement according to claim 1, wherein an outer edge portion of the protruding flange portion (13) intended to be positioned under the roofing is provided with a turned-in flap (13*a*) to stop water penetration under the roofing.

7. A flashing arrangement according to claim 1, wherein a flashing element (9) for connection with the top member of the main frame for formation of a top gutter is provided at the ends thereof with upright (9*b*) and protruding (9*a*) flange portions adapted to overlap the corresponding flange portions (12,13) of the flashing elements (10*a*, 10*b*) connected to the side members of the main frame during mounting of the flashing arrangement.

8. A flashing arrangement according to claim 1, wherein a flashing element (11) for connection with the bottom member of the main frame is provided at the ends thereof with upright (11*b*) and protruding (11*a*) flange portions adapted to be overlapped by the corresponding flange portions (12,13) of the flashing elements (10*a*, 10*b*) connected to the side members of the main frame during mounting of the flashing arrangement.

9. A flashing arrangement according to claim 8, wherein the flashing element (11) for connection with the bottom member is connected at a lower part of its protruding flange portion with a skirt (11*d*) made from a plastically deformable material and of a width sufficient for covering part of the underlying roofing to be sealingly formed against same.

10. A flashing arrangement according to claim 1 wherein the flashing elements are made from metal sheet.

11. A flashing arrangement according to claim 1, wherein the flashing elements are made from synthetic materials.

* * * * *

UNITED STATES PATENT AND TRADEMARK OFFICE
CERTIFICATE OF CORRECTION

PATENT NO. : 5,522,189

DATED : June 4, 1996

INVENTOR(S) : Bent R. Mortensen et al.

It is certified that error appears in the above-identified patent and that said Letters Patent is hereby corrected as shown below:

Cover page, right-hand column, after line 3 insert:

--5,065,553 11/1991 S.J. Magid--;

after line 5, insert

--FOREIGN PATENT DOCUMENTS

| | | |
|---|---|---|
| 148,922 | 11/1985 | Denmark |
| 159,074 | 8/1990 | Denmark |
| 2,142,733 | 7/1978 | Germany |
| 2,910,553 | 9/1980 | Germany |
| 4,032,058 | 5/1991 | Germany |
| 897,984 | 1/1982 | Soviet Union (Abstract)--; |

Column 5, claim 1, line 3, delete "in particular";

claim 2, line 4, "is" should read --are--;
claim 2, line 3, "mutual" should read --mutually--;
claim 4, line 3, delete "in"; and line 6, after "further" insert --comprising--.

Signed and Sealed this

Thirtieth Day of September, 1997

*Attest:*

*Attesting Officer*

BRUCE LEHMAN

*Commissioner of Patents and Trademarks*